US011387010B2

(12) United States Patent
Watson

(10) Patent No.: US 11,387,010 B2
(45) Date of Patent: Jul. 12, 2022

(54) PROTECTIVE GARMENTS AND METHODS FOR USING SAME

(71) Applicant: Kare Mobile, Inc., Louisville, KY (US)

(72) Inventor: Kwane Watson, Louisville, KY (US)

(73) Assignee: Kare Mobile, Inc., Louisville, KY (US)

( * ) Notice: Subject to any disclaimer, the term of this patent is extended or adjusted under 35 U.S.C. 154(b) by 0 days.

(21) Appl. No.: 16/785,548

(22) Filed: Feb. 7, 2020

(65) Prior Publication Data

US 2020/0258645 A1 Aug. 13, 2020

Related U.S. Application Data

(60) Provisional application No. 62/802,277, filed on Feb. 7, 2019.

(51) Int. Cl.
*G21F 3/02* (2006.01)
*A41D 13/00* (2006.01)

(52) U.S. Cl.
CPC ..... *G21F 3/02* (2013.01); *A41D 13/00* (2013.01)

(58) Field of Classification Search
CPC ..... G21F 3/00; G21F 3/02; G21F 3/025
USPC ..... 250/516.1
See application file for complete search history.

(56) References Cited

U.S. PATENT DOCUMENTS 4,220,867 A * 9/1980 Bloch, Jr. ..... G21F 3/02 250/516.1
5,012,114 A * 4/1991 Sisson, Jr. ..... G21F 1/106 250/515.1
5,745,925 A * 5/1998 Ghilardi ..... G21F 3/02 2/457
2005/0211930 A1* 9/2005 DeMeo ..... G01V 5/0008 250/516.1
2010/0163758 A1* 7/2010 Kirschenbaum ..... A61F 13/49007 250/516.1
2014/0367594 A1* 12/2014 Reynolds ..... A41B 3/02 250/516.1
2017/0271035 A1* 9/2017 Sexton ..... A41C 3/0035
2019/0008218 A1* 1/2019 Glickman ..... G21F 3/03

OTHER PUBLICATIONS

UV Protective Clothing, Oct. 20, 2017, Columbia Sportswear, accessed at <https://web.archive.org/web/20171020131112/https://www.columbia.com/uv-protective-clothing/>. (Year: 2017).*

* cited by examiner

*Primary Examiner* — Jason L McCormack
(74) *Attorney, Agent, or Firm* — Quarles & Brady LLP

(57) ABSTRACT

Disclosed herein are protective garments and methods for using the same. In one aspect, the garment includes a garment body configured to be worn on a portion of a wearer's body, the garment body comprising at least one protective segment configured to block a predetermined level of radiation. Also disclosed herein are method of making the disclosed garments and methods for using the disclosed garments.

20 Claims, 6 Drawing Sheets

PROTECTIVE GARMENTS AND METHODS FOR USING SAME

REFERENCE TO RELATED APPLICATIONS

This application claims the benefit of priority to U.S. Provisional Application No. 62/802,277, filed Feb. 7, 2019, which hereby incorporated in its entirety.

FIELD OF DISCLOSURE

The present disclosure relates to garments for protection from radiation exposure and methods for using the same. More specifically, various embodiments of the present disclosure relate to personal protective equipment for use in mobile dentistry.

BACKGROUND OF THE INVENTION

Most current protective garments for preventing radiation use lead as the protective material. The use of lead in protective garments has a number of disadvantages, such as injuries to the workers due to the weight of lead garments and the substantial cost of recycling protective lead garments. There are no garment solutions that provide protective shielding from radiation effortlessly such that the garment can be worn comfortably all day.

Accordingly, there remains a need for new protective garments and equipment that can be worn all day during normal activities while still protecting the worker from radiation exposure. This need and other needs are satisfied by the various aspects of the present disclosure.

SUMMARY OF THE INVENTION

In accordance with the purposes of the invention, as embodied and broadly described herein, the invention, in one aspect, relates to protective equipment and garments, such as for shielding radiation.

In an exemplary aspect, the invention relates to protective garment, the garment comprising a garment body configured to be worn on a portion of a wearer's body, the garment body comprising at least one protective segment configured to block radiation. In further aspects, the garment may comprise a plurality of connected protective segments.

In further aspects, the invention also relates to methods for using the disclosed garments and devices.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DETAILED DESCRIPTION OF THE INVENTION

Figure 1:
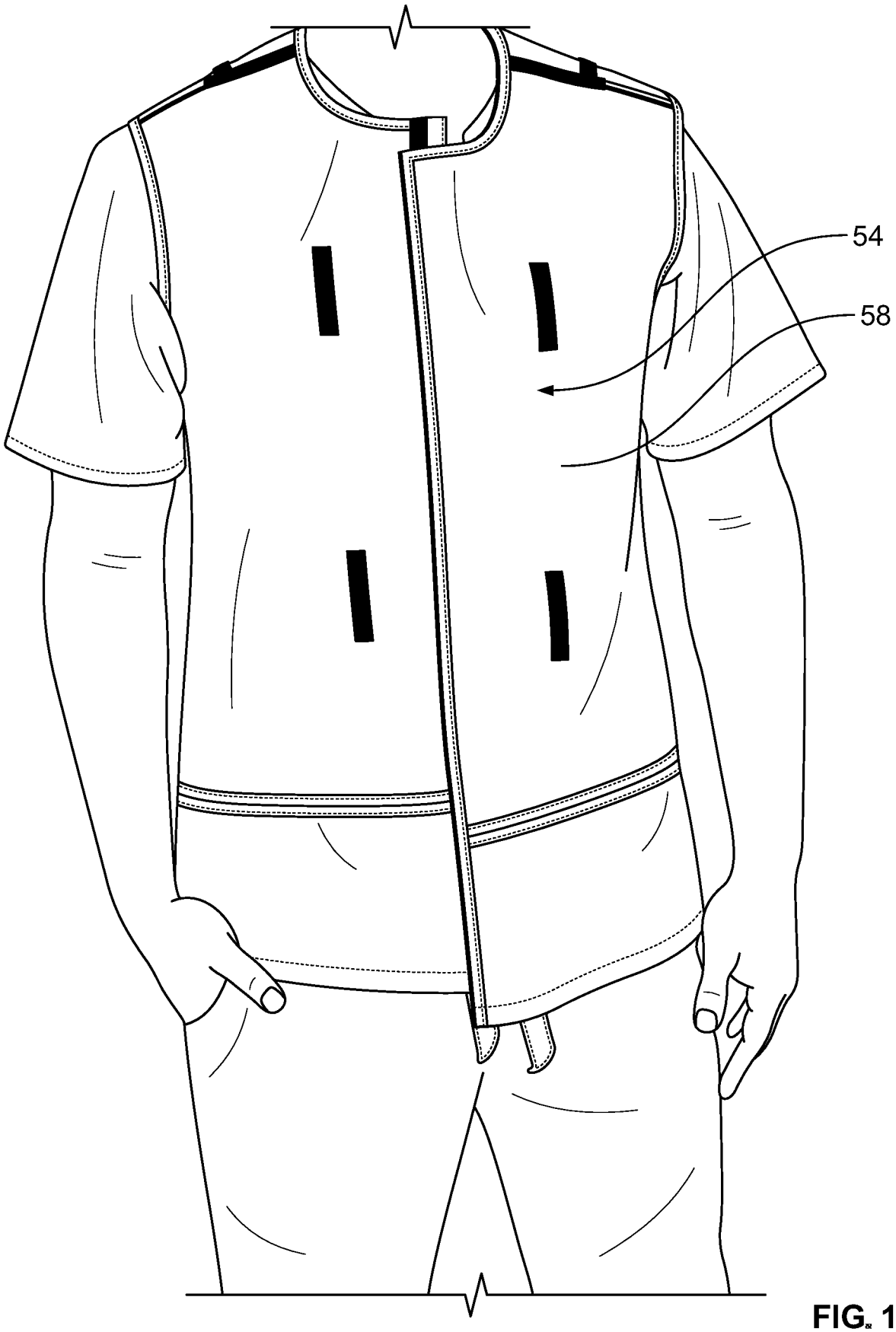
FIG. 1 shows a depiction of a protective garment in accordance with an exemplary embodiment of the present invention.

The present invention can be understood more readily by reference to the following detailed description of the invention and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

All publications mentioned herein are incorporated herein by reference to disclose and describe the methods and/or materials in connection with which the publications are cited.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this invention belongs. In this specification and in the claims, which follow, reference will be made to a number of terms which shall be defined herein.

As used in the specification and the appended claims, the singular forms "a," "an" and "the" include plural referents unless the context clearly dictates otherwise. Thus, for example, reference to "an aperture" includes two or more apertures.

Ranges can be expressed herein as from one particular value, and/or to another particular value. For example, such ranges can include varying fiber combinations and compression intensities. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Disclosed are the components to be used to manufacture the disclosed devices and articles of the invention as well as the materials themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

B. Protective Garments and Methods for Use Same

As briefly described above, the present disclosure relates, in various aspects, to protective garments or equipment, for example, for protecting against radiation exposure. In one aspect, the garment comprises a garment body configured to be worn on a portion of a wearer's body, the garment body comprising at least one protective segment. In further aspects, the garment may comprise a plurality of protective segments. In still further aspects, the garment may comprise a plurality of protective segments pivotably connected to one another.

In further aspects, garments of the present invention can allow wearers, such as dental professionals, to easily, efficiently and effectively protect themselves from radiation exposure in the normal course of their work day without having to don heavy lead aprons when administering radiation, such as when taking radiographs. In still further aspects, the disclosed garments can comprise discreet protective segments or portions that can allow movement with the body's natural movement during normal work activities. The protective garments can be particularly beneficial when working on mobile units or in conditions where handheld x-ray units are used. The protective material can be removable or integrated into the garment and can be positioned from collar to edge of the front of the garment. The garment includes a neck collar 50 and a torso region 54 that extend entirely around a wearer's body (see FIGS. 2 and 3). The garment can extend below the workers waist to protect reproductive organs and all internal organs from thyroid to reproductive region. The protective garment can be effective to keep internal radiation levels below the required protection level even when exterior levels have surpassed 75.

In various embodiments, the protective material can be replicable and/or integrated and virtually undetectable in the garment body. In further aspects, the protective segments are configured to be low profile and contour around the body. In still further aspects, the protective segments are substantially smooth and comprise a substantially similar profile to the non-protective areas of the garment body. In this respect, the disclosed garments do not give the visual appearance that a protective garment is being worn.

In various aspects, exemplary garments of the present invention may comprise, or otherwise take the form of personal protective equipment (PPE), medical scrubs, workwear, such as, and without limitation, jackets, shirts, pants, gowns, sleeves, or any other type of garment that may be worn on a portion of body where radiation exposure may occur. In still further aspects, the garments can accommodate persons of any age, size, or gender, and still allow an individual to experience enhanced protection while wearing the garment. In yet further aspects, the garment can be worn as part of daily work attire, while allowing protection during normal dentistry activities. In other aspects, the garment can be worn during dental activities such as dental procedures, teeth cleanings, and the like.

In further aspects, the garment body may comprise various configurations and shapes. In still further aspects, the garment body may comprise a shape or form that would allow a user to insert various body parts into a portion of garment body and/or cover a portion of a user's body part using the garment body. In yet further aspects, the garment body may comprise or otherwise be in the form of at least one of: pants, jacket, shirt, bodysuit, wrap, glove, or the like. In even further aspects, the garment body comprise one or more portion of the above garment types, such as, for example, a sleeve or the like.

In various aspects, the garment may comprise at least one protective segment, such as radiation protective segment. The protective segments are generally shaped to minimize interference with a wearer's movement or range of motion. In further aspects, a protective segment may be shaped to partially enclose or cover one or more portions of a wearer's body; or contour around a portion of the wearer's body. In still further aspects, the protective segments may be thin and sufficiently flexible to contour around a wearer's body. In yet further aspects, the protective segment may be substantially perpendicular to the wearer's skin surface. In some aspects, portions of the garment body may be omitted from protective segments where necessary to prevent interference with motion of the wearer.

In various aspects, the protective garments comprise a low profile. For example, the protective segments may be substantially smooth and comprise a substantially similar profile to the non-protective areas of the garment body. In further aspects, the protective segments may have a profile from about 0.01 mm to about 10 mm. In still further aspects, the protective segments may have a profile from about 0.1 cm to about 1 cm. In yet further aspects, the protective segments are discreet integrated and configured to contour around a wearer's body. In even further aspects, the protective segments are configured to substantially perpendicular enclose the corresponding area of the body while having a substantially smooth exterior surface. In some aspects, the exterior surface of the protective segments and the non-protective portions of the garment body have the same or substantially same surface properties. For example, the non-protective portions and protective segments are both substantially smooth and contour the body in same or substantially same manner.

In further aspects, the protective segments may be pivotably connected using at least one connecting means or articulation. In yet further aspects, articulations of the garment can allow each of the protective segments to move with its wearer. In even further aspects, the protective segments of the garment are configured and positioned so as to permit a range of motion approximately equal to that of a wearer's body. In still further aspects, one or more articulations may be positioned such that a center of rotation of the articulation is aligned with a center of rotation of a corresponding biological joint.

In further aspects, the garment may comprise one or more protective zones. In yet further aspects, the protective zone may comprise a plurality of protective segments. In still further aspects, the protective zone and/or protective segments are configured to prevent a predetermined level of radiation to a corresponding portion of the wearer's body. In some aspects, the protective zone can shield x-rays from about 0.1 to about 100 keV.

In further aspects, the protective zones may block a predetermined level of radiation along the garment, and thus, along the corresponding portion of a wearer's body it is secured against. In some aspects, the predetermined level of the protective zone may be uniformly distributed along the garment. In other aspects, the predetermined level of radiation protection of the protective zone may be distributed in varying amounts along the garment.

In various aspects, the protective zones comprise a low profile. For example, the protective zones may be substantially smooth and comprise a substantially similar profile to the non-protective areas of the garment body. In further aspects, the protective zones may have a profile from about 0.01 mm to about 10 mm. In still further aspects, the protective zones may have a profile from about 0.1 cm to about 1 cm. In yet further aspects, the protective zones may be discreet integrated and configured to contour around a wearer's body. In even further aspects, the protective zones are configured to substantially perpendicular enclose the corresponding area of the body while having a substantially smooth exterior surface. In some aspects, the exterior surface of the protective zones and the non-protective portions of the garment body have the same or substantially same surface properties. For example, the non-protective portions and protective zones are both substantially smooth and contour the body in same or substantially same manner.

In further aspects, the amount of radiation blocked by a protective segment or protective zone and subsequent protective segments or protective zones may vary, for example to appropriately distribute based on the area of the body. In some aspects, the level of protection exerted by the protective segments may vary gradually from one protective segment to another. In other aspects, the garment may provide varying amounts of protection along a portion of the wearer body with the maximum amount of protection at an area closer to the radiation source. For example, in some aspects, like when used in conjunction with hand held x-ray machines, the protection may be higher closer to the arm and body.

The desired location and protection level for each protective zone along the garment may be determined based upon body anatomy and the amount of expected radiation exposure. In yet further aspects, the garment can be sized to match at least one of: specific body types and body dimensions. In some aspects, the garment may be configured to fit men and women. In other aspects, the garment may be unisex.

According to various embodiments of the present disclosure, the protective segments can comprise a pocket or chamber for holding a protective material. In further aspects, the chamber can be sealed or otherwise constructed to protect the protective material contained in the chamber.

In still further aspects, the protective material can comprise lead equivalent vinyl material that can allow for high flexibility and low profile of the protective segments. In further aspects, the protective material may be a sheet, or other shape formed from one or more protective materials. In still further aspects, the protective material may be treated or otherwise laminated to assist in maintaining the integrity of the protective material and protecting it from damaging elements. In yet further aspects, the treatment or lamination can be any desired treatment or lamination process sufficient to contain an integrated form and shape of the protective material while allowing the garment to be washed and used during dentistry activities.

As described above, garments of the present invention may comprise single or multiple layer construction. The garments comprise a first layer or under layer or protective layer 58 and a second layer or over layer or outer layer 60 (see FIG. 3). In further aspects, the garment may comprise multi-layer construction where incorporation or integration of the protective segments may be achieved by, for example, by introducing the protective material between layers and forming articulations between the protective material. In further aspects, the garment body and protective segments may be integrated in the form of a two-ply construction in the portions where they are attached or overlap. In yet further aspects, the protective segments may be integrated in the garment body. In still further aspects, the protective segments may be attached or otherwise incorporated into the garment body by at least one of: insertion, embossing, taping, bonding, and patch application, and the like.

Figure 2:
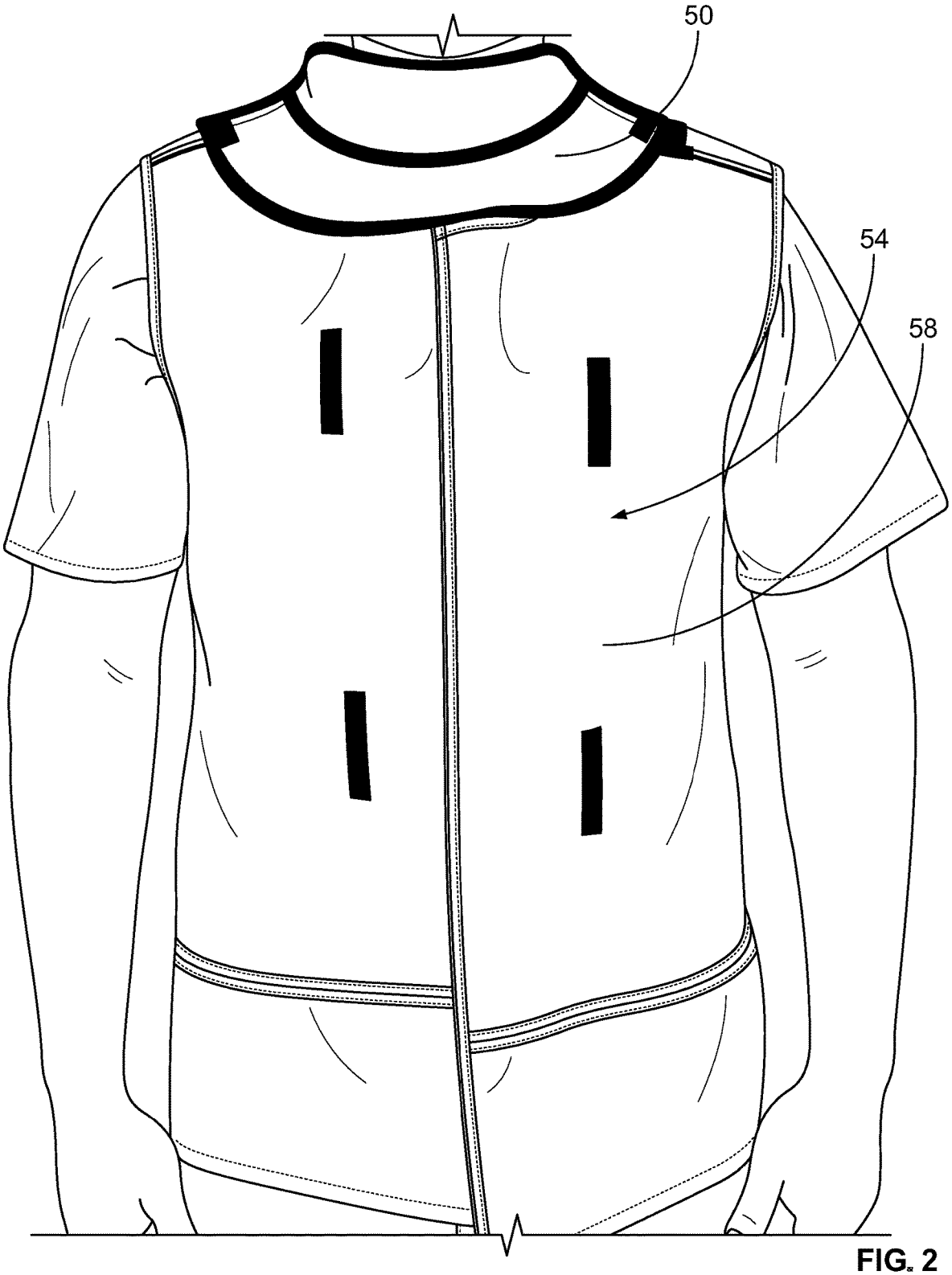
FIG. 2 shows a depiction of a protective garment in accordance with an exemplary embodiment of the present invention.
Figure 3:
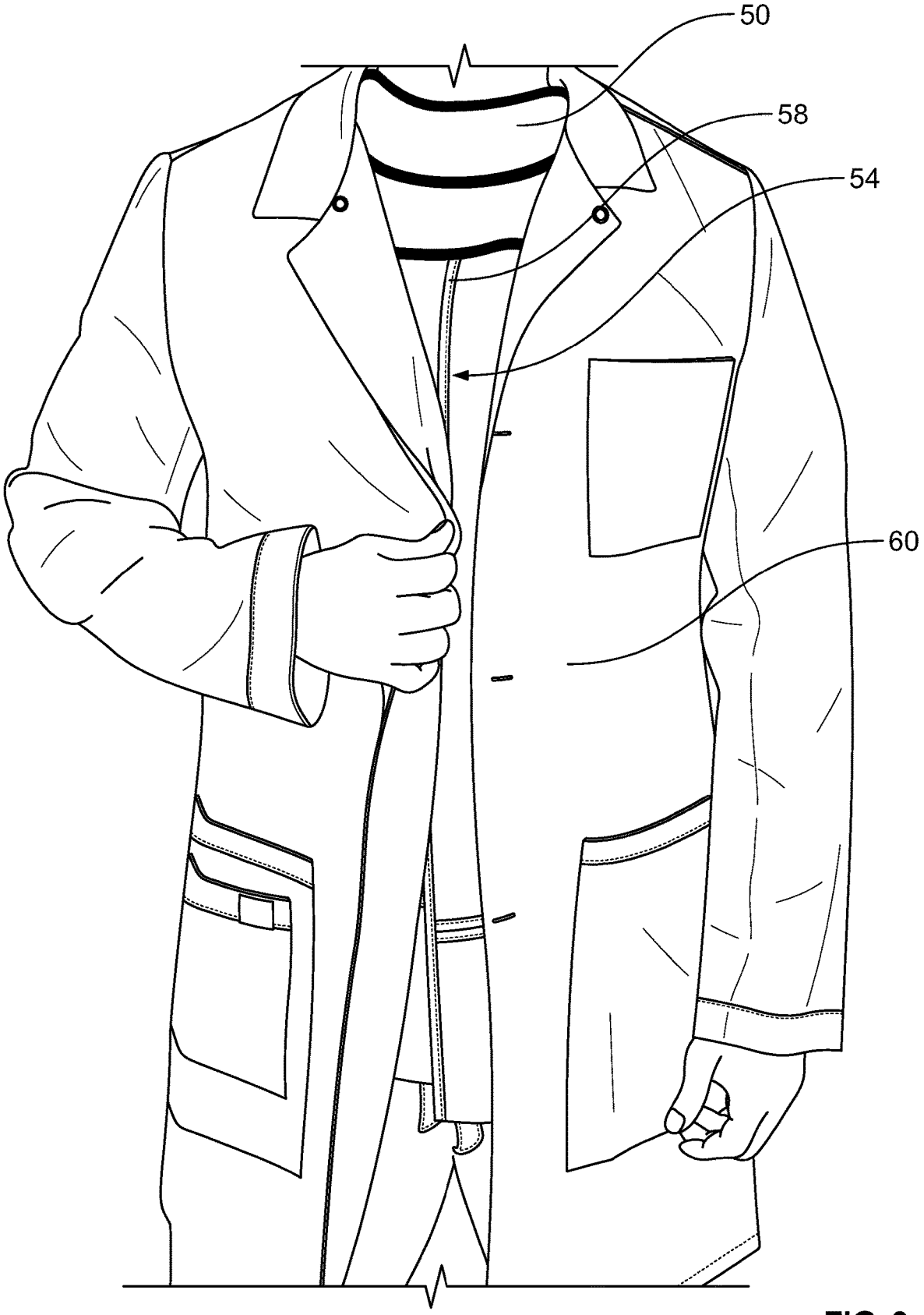
FIG. 3 shows a depiction of a protective garment in accordance with an exemplary embodiment of the present invention.
Figure 4:
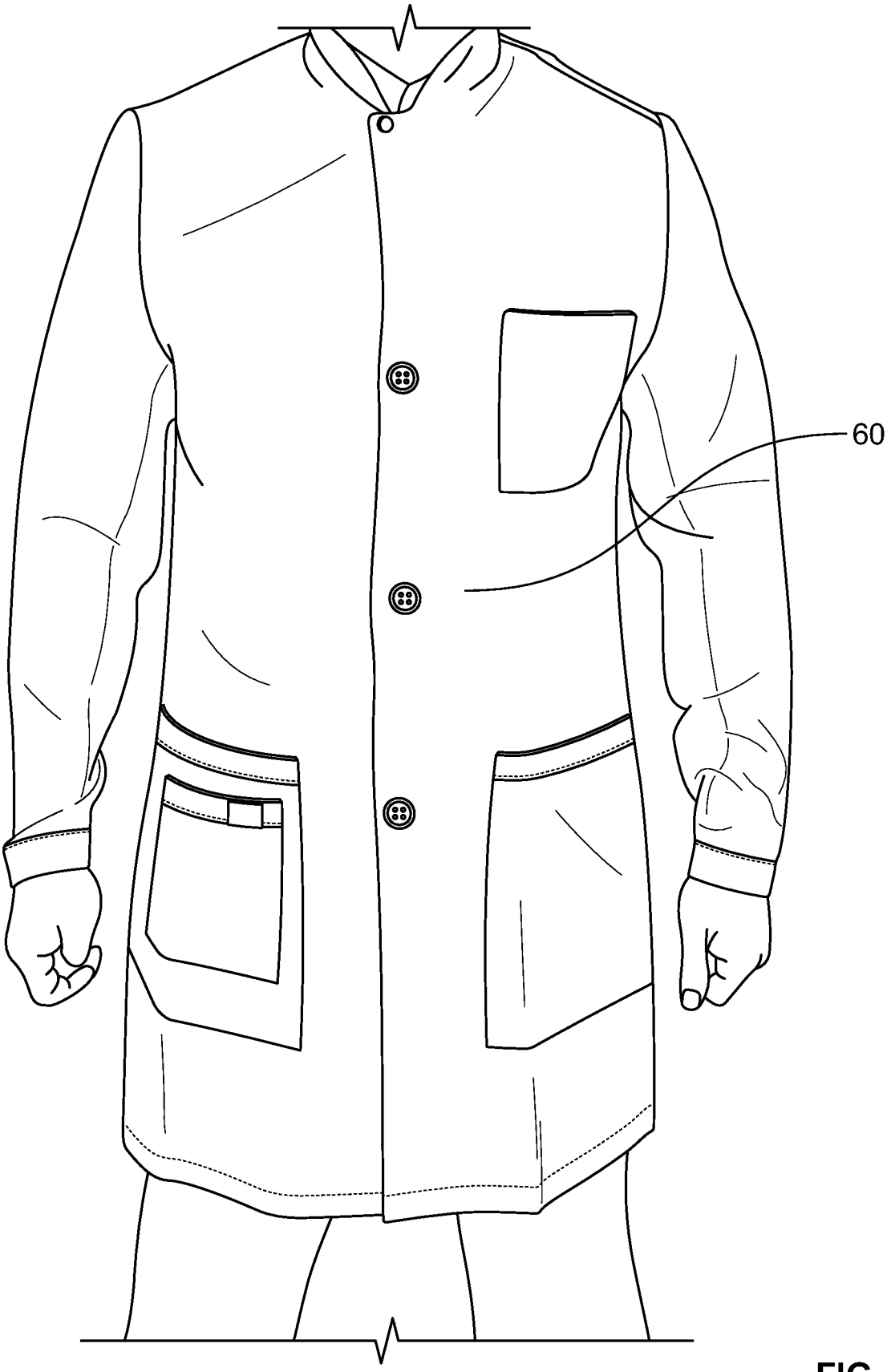
FIG. 4 shows a depiction of a protective garment in accordance with an exemplary embodiment of the present invention.
Figure 5:
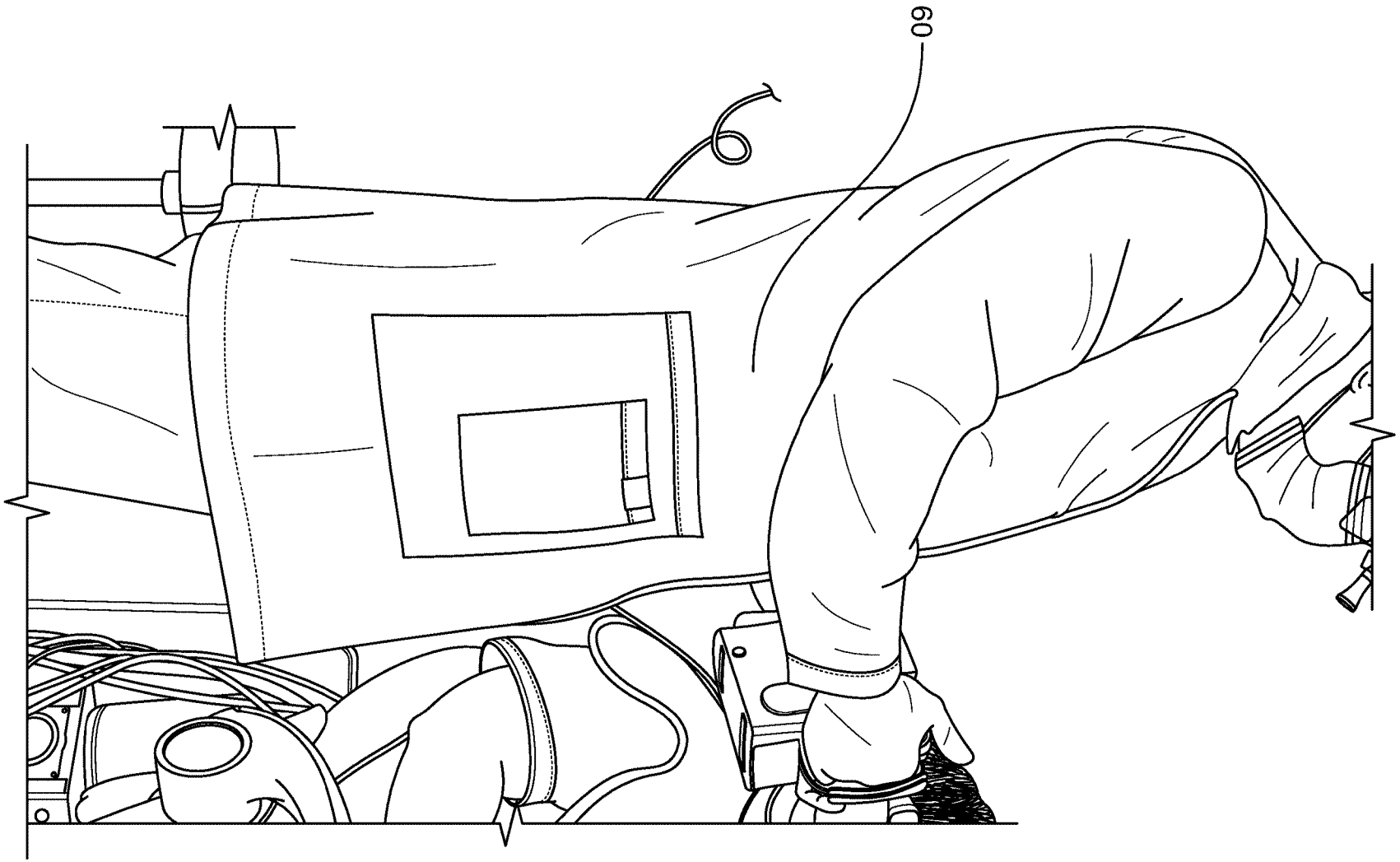
FIG. 5 shows a depiction of protective garment in use during a dental procedure in accordance with an exemplary embodiment of the present invention.

In further aspects, the garment may comprise one or more attachment means selected from buttons, hooks, snaps, fasteners, VELCRO, or the like, or combinations thereof to removably attach the protective layer 58 to the outer layer 60 (see FIGS. 2-4). In still further aspects, the garment may comprise one or more support bands configured to be flexibly secured against a portion of a wearer's body. In even further aspects, the support band may comprise an elastic material, elastic bands, or the like. In yet further aspects, the garment may comprise one or more closure means. In still further aspects, the closure means may define an outermost edge of the garment. In yet further aspects, the closure means may comprise a strap, cord, cord or strap locks, zipper, buttons, snaps, clips, hooks, VELCRO, fasteners, and combinations thereof.

In various aspects, the garment body may comprise a plurality of materials. In further aspects, the protective material can comprise a lead-equivalent thermoplastic material, thermoplastic sheet, such as neoprene, nylon, polypropylene, polyurethane, vinyl plastic or the like. In still further aspects, the protective material can be comprised of vinyl, ethylene-vinyl acetate (EVA), poly (ethylene-vinyl acetate) (PEVA), or a copolymer of vinyl, or the like. In even further aspects, the protective material can comprise compounds with base resins such as nylons, nylon elastomers, and thermoplastic elastomers (TPE) and metallic fillers. In yet further aspects, the protective material can have a lead equivalency or PB rating of from about 0.01 mmPb to about 1.0 mmPb, including exemplary values of 0.1, 0.2, 0.3, 0.4, 0.5, 0.6, 0.7, 0.8, and 0.9 mmPb. In still further aspects, the protective material may have a thickness from about 0.01 mm to about 10 mm, including exemplary values of 0.1, 0.2, 0.3, 0.4, 0.5, 0.6, 0.7, 0.8, and 0.9 mm.

In further aspects, the garment body may comprise soft, breathable material. In even further aspects, the material can comprise a fabric, laminated material, film, sheet, coated fabric, or combinations thereof. In still further aspects, the fabric may comprise a woven fabric, non-woven fabric, natural fabric, synthetic fabric, or combinations thereof. In even further aspects, the garment body material may comprise latex, LYCRA, nylon, spandex, elastane, polyester, lace, silk and/or cotton, bamboo pulp, cotton, polyester, Gore-Tex, nylon, polypropylene, spandex, Tencel wool, or x-static or a combination thereof. In yet further aspects, the garment may be machine washable and allow stretch and recovery. In still further aspects, the garment body material may comprise varying fiber combinations. In other aspects, the garment may be comprised of water-resistant or waterproof material, and the garment can be washed and/or worn during dental activities involving fluids, such as teeth cleaning.

In various aspects, the garment can be configured and sized to fit all body types and sizes. In further aspects, the garment may be sized to correspond with standard sizing associated with garments. For example, the garment may be sized as xs, s, m, l, xl, 1x, 2x, 3x, and the like.

In further aspects, the garment may be OSHA compliant. In still further aspects, the garment may function as "general work clothes" and as outer protective garment (PPE). OSHA defines Personal Protective Equipment as: specialized clothing or equipment worn by an employee for protection against a hazard. General work clothes (e.g., uniforms, pants, shirts or blouses) not intended to function as protection against a hazard are not considered to be Personal Protective Equipment. In still further aspects, the disclosed garments are compliant with OSHA's Bloodborne Pathogens Standard.

In further aspects, the disclosed garments can protect skin and street clothes that could become contaminated. In still further aspects, the garment may include one or more of the following features: High-necked/high-collared, Long sleeves, Covers the knees when seated.

Also disclosed herein are methods of using the disclosed garments. For example, in another exemplary aspect, the present disclosure provides a method for using a disclosed garment for preventing radiation exposure. In further aspects, the method can further comprise wearing the garment during dentistry activities.

According to various aspects of the invention, the garments of the present disclosure can comprise multiple configurations. For example, various exemplary embodiments of the inventive garments and methods are shown in FIGS. 1-6. In further aspects, FIGS. 1-5 show various features and components of exemplary protective garment in the form of a jacket. In this embodiment, the garment body comprises two arm portions and a trunk or body portion. The trunk portion comprises two protective zones, the protective zone extending from collar to edge of the front of the jacket. Each protective zone comprises a protective segment connected on the inside of the garment body, and is configured to protect reproductive organs and all internal organs from thyroid to reproductive region. While this embodiment only depicts one discrete protective zone per side, the present invention may utilize any number of protective zones among the garment body to achieve the desired level of protection from radiation exposure.

EXAMPLES

The following examples are put forth so as to provide those of ordinary skill in the art with a complete disclosure and description of how the compounds, compositions, articles, devices and/or methods claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

The Examples are provided herein to illustrate the invention, and should not be construed as limiting the invention in any way. Examples are provided herein to illustrate the invention and should not be construed as limiting the invention in any way.

In this Example, the effect of radiation on the disclosed protective garment was evaluated. A Dexcowin portable X-ray camera (DX3000) was used to evaluate radiation for: (1) protective garment (PPE) with radiation protection in accordance with the present invention; and (2) protective garment without radiation protection.

Figure 6:
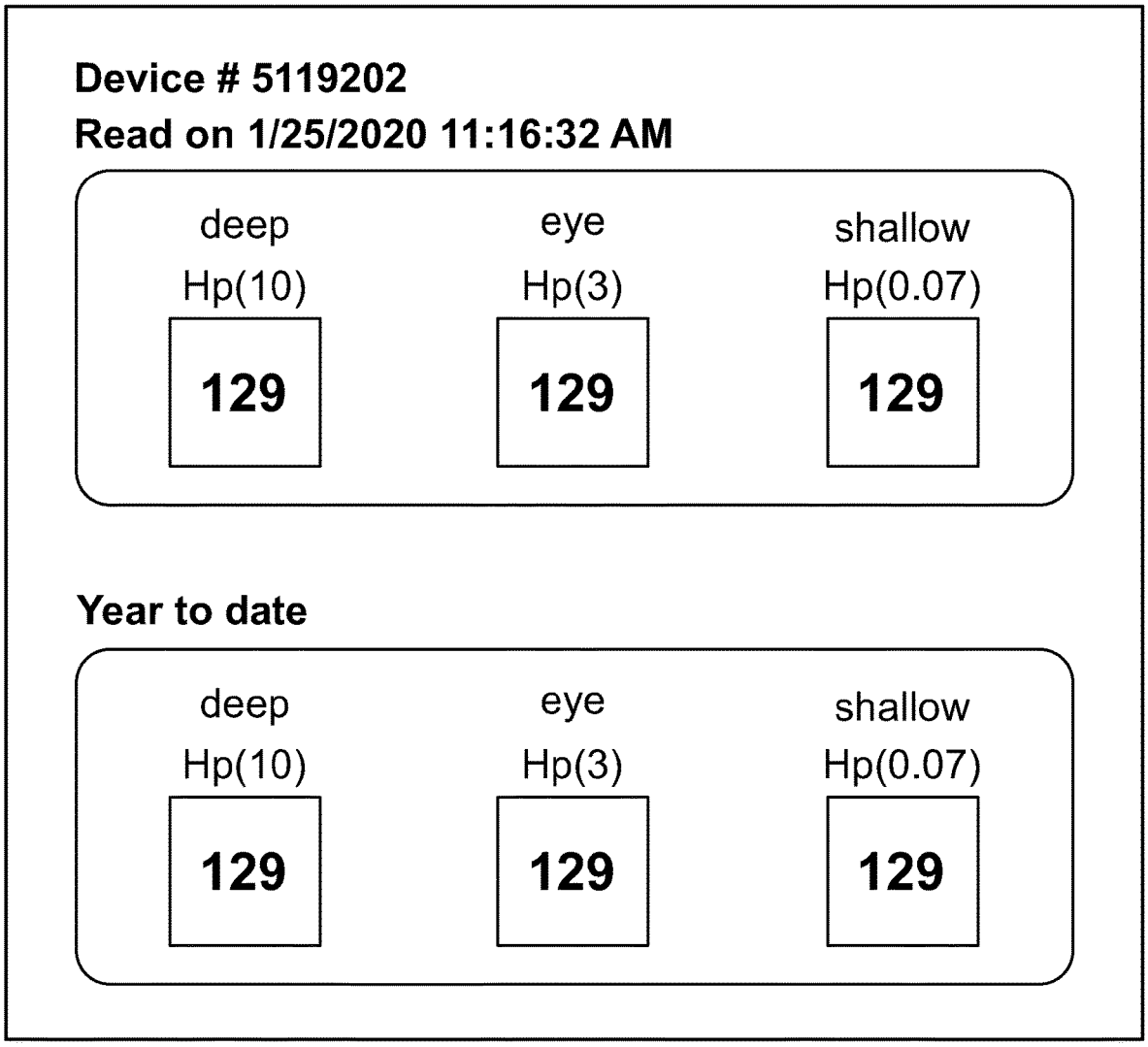
FIG. 6 shows a depiction of a radiation test result in connection with a protective garment in accordance with an exemplary embodiment of the present invention.

For garment (1), KVP WAS SET TO 1.35 s WITH THE COVERAGE OF THE Protective Garment. The camera was held 6 inches above the sensor which was covered with the PPE Jacket for 120 exposures. As shown in FIG. 6, results show protective garment with radiation protection was within acceptable radiation limits.

For (2), KVP WAS SET TO 1.35 s WITHOUT radiation protections. The camera was held 6 inches above the uncovered and unprotected sensor for 120 exposures. Results for (2): The indicator exceeded the radiation limit.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications are referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein can be different from the actual publication dates, which can require independent confirmation.

The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed:

1. A protective garment, the garment comprising:

a garment body configured to be worn on a portion of a wearer's body, the garment body comprising a neck collar and a torso region, the garment also comprising at least one protective segment that extends around the neck collar and the torso region, wherein the garment body comprises a multiple layer construction that includes a protective layer and an outer layer, the protective layer being removably attached to the outer layer, the outer layer being open on a front side of the wearer's body and extending continuously around a rear side of the wearer's body, wherein when worn by a wearer, the at least one protective segment is configured to prevent radiation exposure from x-rays to a portion of the wearer's body, and wherein the neck collar extends continuously around a wearer's neck, and the neck collar is removably attached to the torso region.

2. The garment of claim 1, further comprising a plurality of protective segments.

3. The garment of claim 2, wherein the plurality of protective segments are pivotably connected to one another.

4. The garment of claim 3, wherein the protective segments are pivotably connected using at least one connecting means or articulation.

5. The garment of claim 4, wherein the at least one protective segment extends entirely around the neck collar and the torso region, and wherein the at least one protective segment comprises at least one protective zone or band.

6. The garment of claim 5, further comprising a plurality of protective zones.

7. The garment of claim 6, wherein the protective zone and/or protective segments are configured to protect a predetermined level of radiation exposure to a portion of the wearer's body.

8. The garment of claim 7, wherein the protective segments comprise a pocket or chamber for holding a protective material.

9. The garment of claim 8, wherein the chamber is sealed.

10. The garment of claim 9, wherein the protective material comprises a thermoplastic material.

11. The garment of claim 10, wherein the protective material comprises a lead rating of from about 0.1 mmPB to about 0.5 mmPB.

12. The garment of claim 11, wherein the protective segments are removable from the garment body.

13. The garment of claim 11, wherein the protective segments are integrated in the garment body.

14. The garment of claim 11, wherein the protective segments are attached to the garment body by at least one of: insertion, embossing, tape, bonding, and patch application.

15. The garment of claim 11, wherein the garment body comprises a jacket, robe, apron, pants, shirt, bodysuit, wrap, glove, or a combination thereof.

16. The garment of claim 15, wherein the distribution of protective segments is configured to block and/or shield radiation exposure.

17. A protective garment, the garment comprising:

a garment body having a neck collar and a torso region, the torso region having a trunk portion and two arm portions and configured to be worn on a portion of a wearer's body, the garment also comprising a plurality of protective segments configured to absorb a predetermined amount of radiation, wherein the plurality of protective segments contour continuously around the wearer's body to prevent radiation exposure from x-rays, wherein the garment body is a multiple layer construction that include a protective layer and an outer layer, the outer layer being open on a front side of the wearer's body and extending continuously across a rear side of the wearer's body, and wherein the neck collar extends continuously around a wearer's neck, and the neck collar is removably attached to the torso region.

18. A method for preventing radiation exposure during a dental procedure, the method comprising the steps of:

a) providing the garment of claim 16; and b) wearing at least one portion of the garment to prevent radiation exposure when administering x-ray.

19. The method of claim 18, wherein the step of wearing at least one portion of the garment comprises wearing at least one portion of the garment during dental procedure.

20. The garment of claim 17, wherein the protective layer is removably attached to the outer layer, and the protective layer is configured to be worn under the outer layer.

* * * * *